United States Patent [19]

Trickel

[11] 4,280,694

[45] Jul. 28, 1981

[54] RACE TRACK LURE SPEED CONTROL ASSEMBLY

[76] Inventor: Lorn L. Trickel, 8806 NE. Thompson St., Portland, Oreg. 97220

[21] Appl. No.: 141,641

[22] Filed: Apr. 18, 1980

[51] Int. Cl.[3] ..... A63K 1/02

[52] U.S. Cl. ..... 272/4

[58] Field of Search ..... 272/4, 5, DIG. 6; 46/234

[56] References Cited

U.S. PATENT DOCUMENTS

| | | | |
|---|---|---|---|
| 1,675,972 | 7/1928 | Cox | 272/4 |
| 1,965,287 | 7/1934 | Heintz | 272/4 |
| 1,997,010 | 4/1935 | Nelson | 272/4 |
| 2,430,403 | 11/1947 | Le Mire | 272/4 |
| 2,869,478 | 1/1959 | White | 272/4 |
| 4,070,016 | 1/1978 | Dumas | 272/4 |

FOREIGN PATENT DOCUMENTS

| | | | |
|---|---|---|---|
| 623547 | 5/1949 | United Kingdom | 272/4 |
| 1444688 | 8/1976 | United Kingdom | 272/4 |

*Primary Examiner*—George J. Marlo
*Attorney, Agent, or Firm*—Eugene D. Farley

[57] ABSTRACT

An automatic lure speed control assembly for a race track having a conventional track, rails extending along the track, and a lure movably supported by an electric motor driven carriage. Placed sequentially along the track are electric inductive loops for traversal by contestants during a race. The contestants wear blankets in which is implanted an inductance altering element. An electric circuit, including the inductive loops, selected rails, and the motor is operable to control the rate of advancement of the lure as required to maintain it immediately ahead of the lead contestant.

12 Claims, 6 Drawing Figures

RACE TRACK LURE SPEED CONTROL ASSEMBLY

BACKGROUND OF THE INVENTION

This invention relates to race track equipment, and more particularly to a control system for automatically maintaining a lure immediately ahead of the lead contestant in a race. It is described herein with reference to a control system for regulating the speed of a mechanical rabbit lure in dog racing, although no limitation thereby is intended.

It has long been the custom in dog tracks to provide a mechanical rabbit lure, carried on the end of an arm extending over the track and in the path of the dogs. The lure is advanced by an electric motor mounted on a carriage which supports the arm and travels on a pair of rails alongside the track. It is the purpose of the lure to excite the dogs and to give them incentive to race and the lure is maintained only a short distance in front of the lead contestant.

Since there is a variation in the dogs' speed, the speed of the mechanical lure must also be variable. Previously this has been accomplished by stationing a lure operator high in the grandstands, overlooking the track. The operator manually adjusts a rheostat or a variable transformer, supplying the appropriate voltage to the motor on the carriage to keep it at the proper speed. This procedure is prone to human error and costly in terms of personnel.

If the lure operator permits the lure to travel too slowly, a dangerous collision may result when the dogs overtake the lure. On the other hand, if the lure operator overcompensates and permits the lure to get too far ahead of the dogs, the dogs may lose sight of the lure or become disinterested in the race.

A common dog race track feature is an automatic starting release for the dogs. The release is usually actuated by the carriage as it begins its traverse around the track, thus assuring common start timing in all races.

Another common feature of prior art tracks is the presence of an audible sound simulating the natural cry of a quarry in distress or being pursued, as a stimulation and further incentive for the dogs to race.

Heretofore, in other forms of racing the location of the contestants has been detected by using a small radio transmitter worn by each contestant. The transmitter sends out a signal which is detected by an antenna, several of which are located at various positions along the track. Such a system requires a package of complex electronics to be attached to each contestant and involves possible invalidation of the race if just one of the electronic packages fails.

Another device used for detecting the location of the contestants during a race includes photo cells mounted around the periphery of the track. The use of such a device is subject to the disadvantage that it requires the constant maintenance of photo cell optical elements in a dusty environment.

Other related art discloses model train tracks equipped with block systems. Such systems have for their function stopping a train if it is following another train too closely. The systems act on the rear train, and do not affect the motion of the front train. Since in the present invention it is the speed of the lure which must be altered, a similar block system is not applicable.

Accordingly, it is the general object of the present invention to provide an automatic control assembly for controlling the rate of advancement of a mechanical lure in a race track.

It is a further object of the present invention to eliminate the need for a lure operator.

It is a still further object of this invention to provide an accurate means of maintaining the lure immediately ahead of the lead contestant.

It is another object of this invention to provide a means of detecting the lead contestant which requires but minimum maintenance in the normal track environment.

It is a still further object of this invention to provide a reliable detection system for detecting the position of the lead contestant where the device carried by each contestant is not prone to malfunction.

BRIEF SUMMARY OF THE INVENTION

The race track lure speed control assembly of the present invention generally provides an automatic control assembly for use with a lure mounted on a motor-driven carriage, including a plurality of inductive loops placed sequentially along the track for traversal by contestants during a race, an inductance altering element carried by each contestant, and an electric circuit responsive to a change in inductance and operable to modify the speed of the motor, and hence the rate of advancement of the lure, as required to maintain the lure immediately ahead of the lead contestant. As the contestants traverse each inductive loop the inductance altering element carried by the lead contestant is detected and, if necessary, the electric circuit modifies the speed of the lure, maintaining it ahead of the lead contestant.

DETAILED DESCRIPTION OF THE PREFERRED EMBODIMENTS

Figure 1:
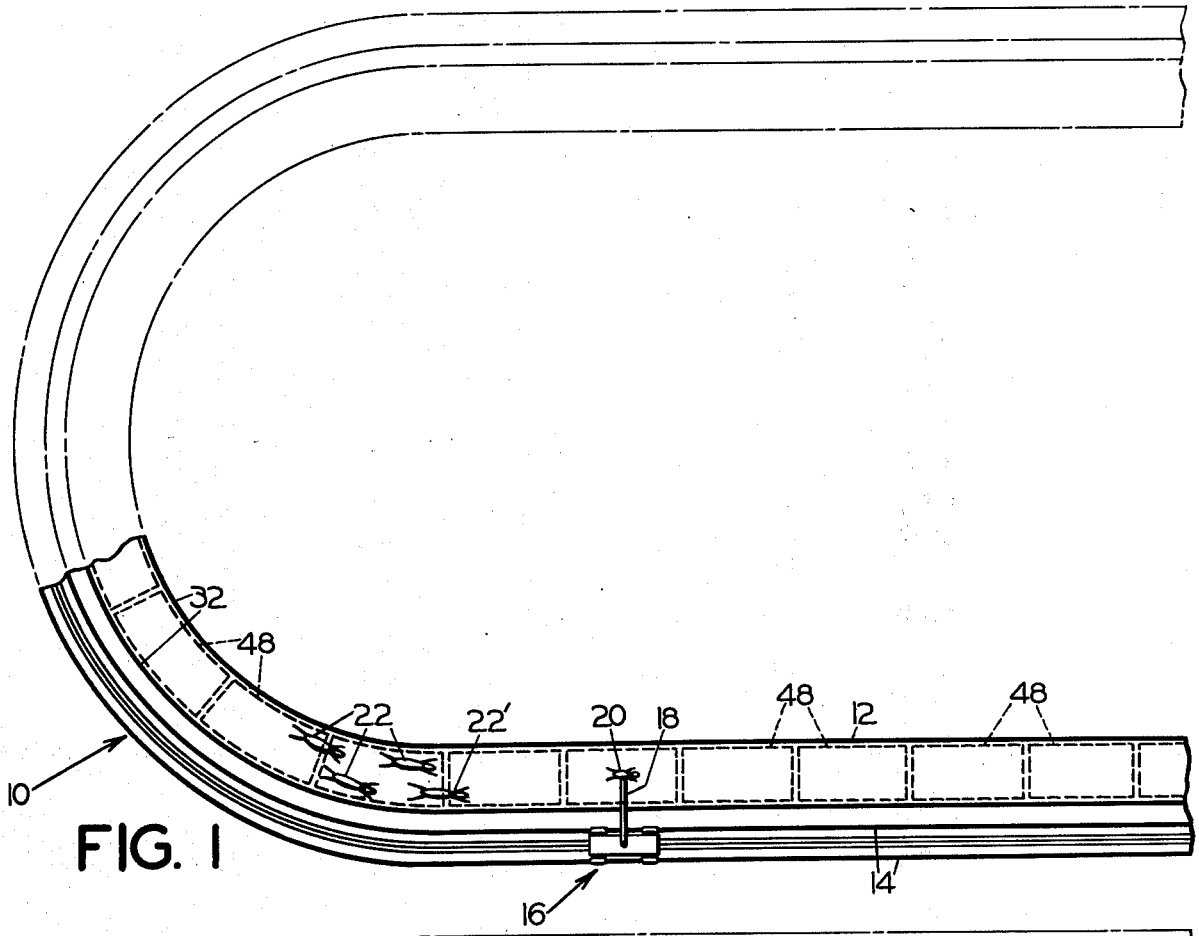
FIG. 1 is a fragmentary plan view of a race track illustrating the application of the lure speed control assembly of my invention in a first embodiment.
Figure 5:
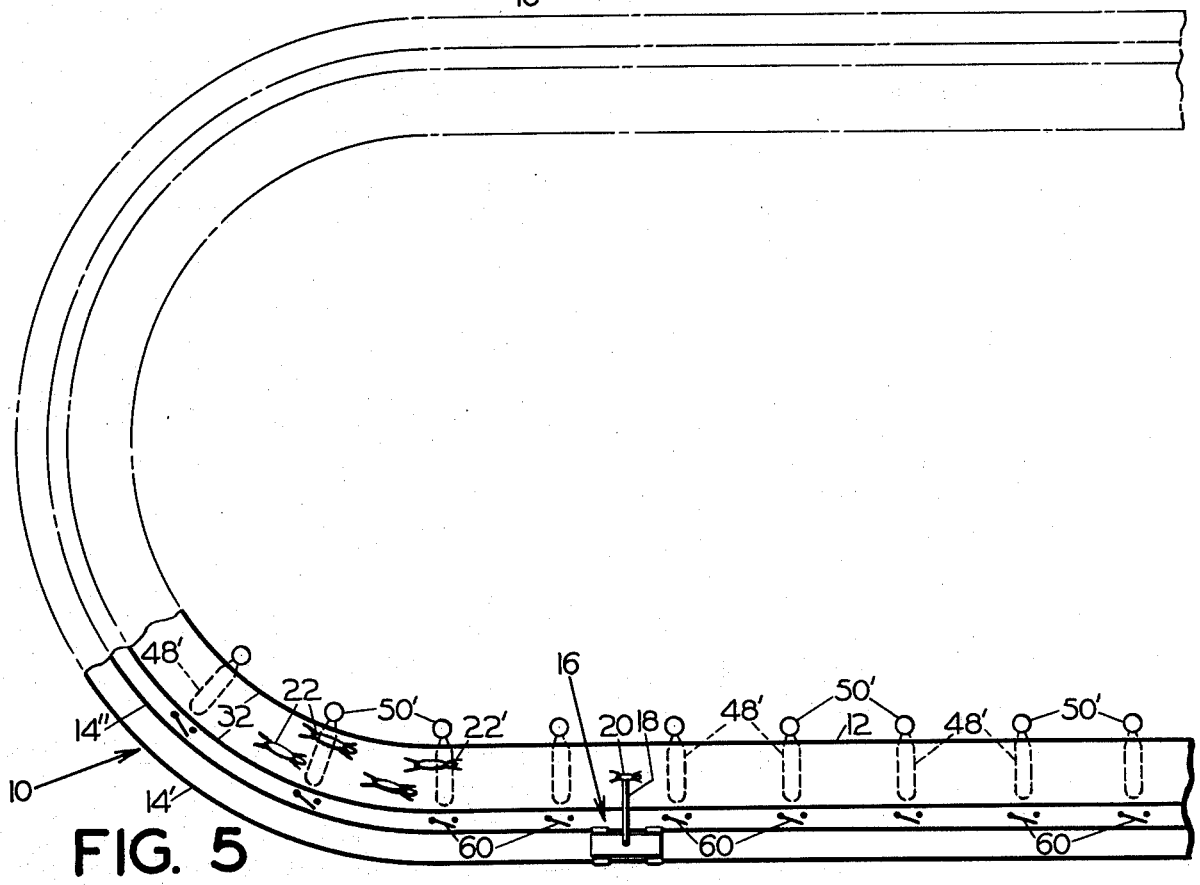
FIG. 5 is a fragmentary plan view of the race track showing the application of my invention in a second embodiment.

A dog race track incorporating the control system of the present invention is shown generally at 10 (in FIGS. 1 and 5). The conventional track includes a track oval 12, a pair of guide rails 14 alongside the track, and a carriage 16 which rides upon the guide rails. The carriage mounts an arm 18 which extends over the track and holds a mechanical rabbit lure 20. Contestants 22 are thus encouraged to race as the lure is maintained immediately in front of them. The lead contestant is designated by 22'.

Figure 3:
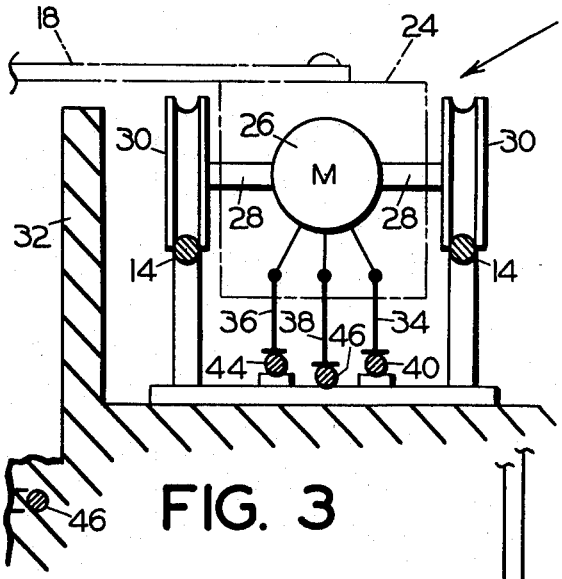
FIG. 3 is a traverse section taken along line 3—3 in FIG. 2 showing the carriage, a three conductor trolley electrical pickup and the electric motor in schematic.

Carriage 16 is shown in FIG. 3 in a schematic form of the first embodiment. It includes a frame 24, a motor 26 supported on the frame, axles 28, at least one of which is driven by the motor, and wheels 30 connected to the axles and rollable on guide rails 14. The carriage is hidden from the view of the contestants 22 by a wall 32 at the edge of the track.

The motor 26 is supplied power through trolley pickups 34, 36 and 38. Each trolley pickup makes contact with a selected electric rail. In the first embodiment, illustrated in FIGS. 1, 2 and 3, three electric rails extend along track 10.

First electric rail 40 is a low voltage rail operable to drive motor 26 and hence carriage 16 at a low speed, less than the speed of the lead contestant, when voltage is applied thereto. Manual switch 42 is operable to apply voltage to the low voltage rail.

Second electric rail 44 is a high voltage rail operable to drive the motor, and hence the carriage, at a high speed, greater than the speed of the lead contestant, when voltage is applied thereto, overriding the low voltage rail. The high voltage rail is segmented, each segment conductively disassociated with the adjacent segments.

Third electric rail 46 is a ground to which the other voltages are relative.

Figure 2:
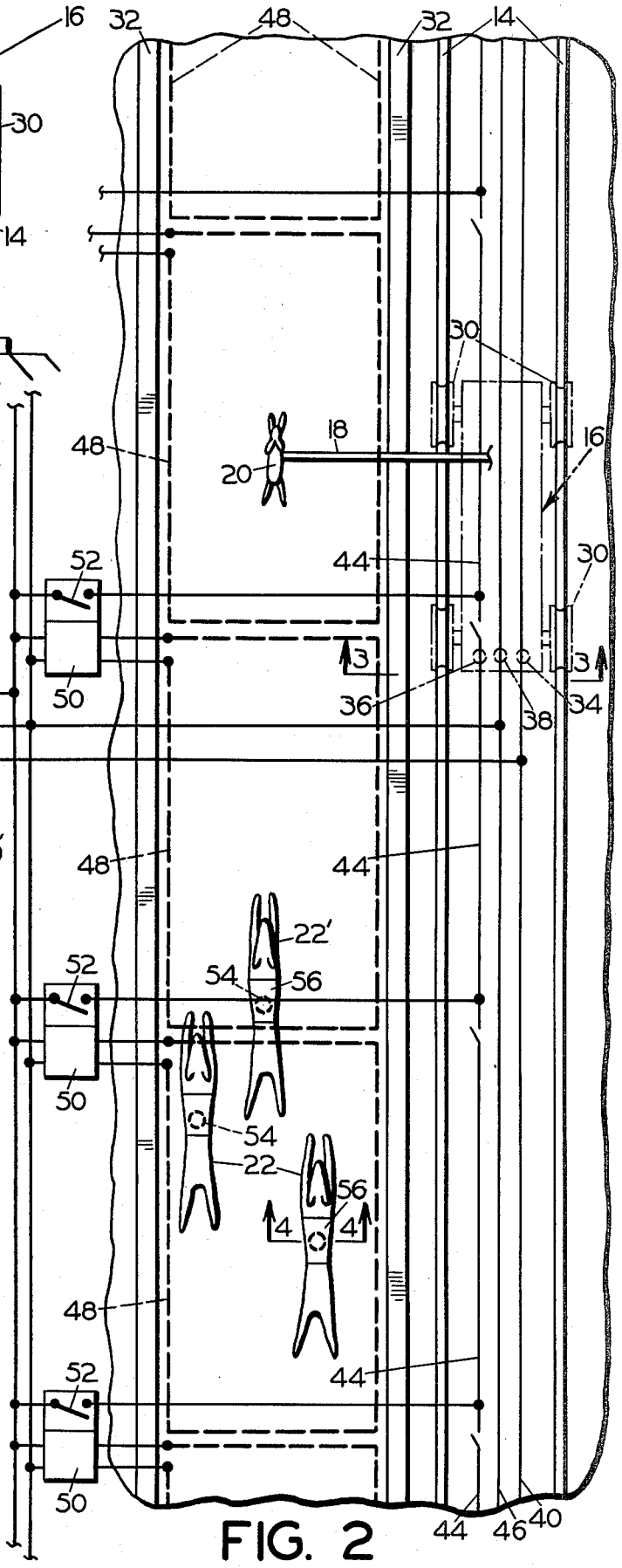
FIG. 2 is a fragmentary plan view of the track, similar to FIG. 1 showing the wiring diagram of the first embodiment.

As best shown in FIG. 2, an electric circuit includes a plurality of first inductive loops 48 which are placed along and preferably underlie track oval 12. Each first loop extends substantially across the width of the track oval and along the length thereof to a point adjacent the next inductive loop. The distance that each inductive loop extends along the track is substantially equal to the length of one of the segments of high voltage rail 44.

In the circuit, a detector 50 is electrically connected to each first inductive loop 48 and is operable to detect a change of inductance in the loop. The detector is also electrically connected to an associated control means 52. The control means in turn is connected electrically to an associated segment of the high voltage rail 44 and is operable to apply voltage selectively thereto.

Figure 4:
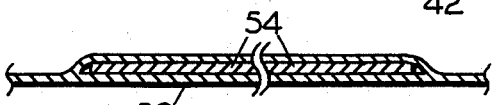
FIG. 4 is a fragmentary section of the contestant's blanket taken along line 4—4 in FIG. 2, showing the inductance altering element.

Each contestant 22 carries an inductance altering element. As shown in FIG. 4 the inductance altering element is preferably a ferromagnetic foil 54 sewn into a blanket 56 worn by the contestant. The blanket may also display the contestant's racing number or other insignia. The ferromagnetic foil is detectable as each first inductive loop 48 is traversed by the contestants.

Figure 6:
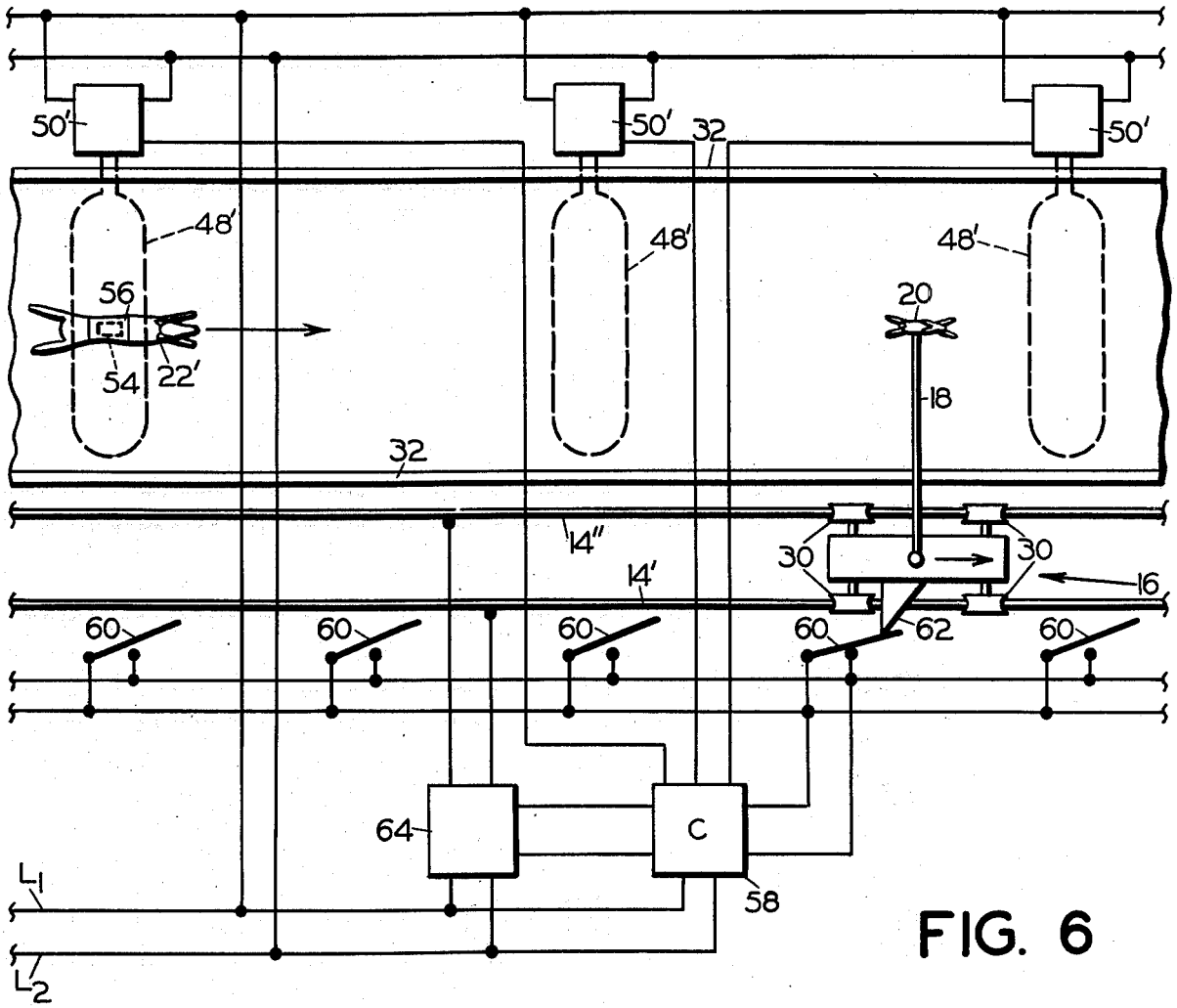
FIG. 6 is a fragmentary plan view of the track, similar to FIG. 5, showing the wiring diagram of the second embodiment.

In the second embodiment of the present invention, shown in FIGS. 5 and 6, the electric circuit includes a plurality of second inductive loops 48' which are mounted at spaced apart locations along and preferably under the surface of track oval 12. Each second inductive loop extends substantially across, but only a short distance along the track oval. A second detector 50' is electrically attached to each second inductive loop and is operable to detect a change in inductance and generate an output signal. The output of each second detector is electrically connected to a computing means 58 which is operable to process the signals from all second detectors as they are received.

Also included in the electric circuit of the second embodiment is a plurality of switches 60, arranged along track 10 at spaced apart locations, and engagement means 62 mounted on the carriage 16 for successively engaging the switches upon passage of the carriage. The switches are electrically connected in parallel to the computing means 58, which is operable to process the signal generated by the sequential momentary closure of each switch.

Computing means 58 is programmed to accept the signals from the detector 50' and the switches 60 and to process the information to determine the positions and relative speed of the lure 20 and the lead contestant 22'.

The output from the computing means is operable to control a variable voltage regulator, preferably a silicon controlled rectifier 64. A voltage which may be varied is thus able to be supplied to the electric rails, which are shown in FIGS. 5 and 6 as guide rails 14' and 14". Rail 14' is a ground and rail 14" is a variable voltage rail. The motor 26 is operable to receive its power through a pair of trolley pickups (not shown) and drive the carriage at a variable speed which is a function of the voltage.

OPERATION

In the first embodiment, contestants 22 are held in their starting boxes (not shown) until the beginning of the race. When the race is about to begin, voltage is applied to low voltage rail 40 and carriage 16 begins to move along the track 10 at its low speed. When the carriage is in front of the starting line a predetermined distance, it trips a switch (not shown) which releases the contestants. Lure 20 then attracts the contestants and induces them to race.

As the lead contestant 22' passes into the field of one of the inductive loops 48 the ferromagnetic foil 54 in the contestants blanket 56 causes a change in the inductance of the loop. This change is detected by detector 50 which activates control means 52 and in turn applies power to the segment of high voltage rail 44 which is associated with the loop. As the lead contestant approaches within a predetermined distance of the lure 20, the speed of the motor 26 is consequently increased and the carriage 16 speeds up to move away from the lead contestant. Thus, the lure is always maintained immediately ahead of the contestants.

In the second embodiment, the contestants 22 traverse inductive loops 48' and, in doing so, the ferromagnetic foil 54 which they each carry causes a short duration change in the inductance of each loop. The second detector 50' senses the change, and sends a signal to computing means 58.

As the carriage 16 moves along the guide rails 14' and 14" from which the motor 26 also obtains its power, engagement means 62 successively engages switches 60. The momentary closure of each switch sends a signal to computing means 58.

The signals received by computing means 58 from second detectors 50' and switches 60 are processed to determine the speed of the lure 20 and lead contestant 22' and their separation. The preferred operation of the computing means is first to note the split time in which the lead contestant traverses two inductive loops 48'.

Second, the split time is noted in which the lure or carriage 16 traverses the distance between two switches. Then the ratio of the split times is computed to produce a control factor. The existing voltage is multiplied by the control factor to obtain a new voltage. An output signal representing the new voltage controls the silicon controlled rectifier 64. The variable voltage between rails 14' and 14" is thus adjusted to propel carriage 16 at a rate which keeps the lure a predetermined distance ahead of the lead contestant.

Having described my invention in its preferred embodiments, I claim:

1. For use with a powered race track lure assembly including a lure, an electric-motor-driven carriage mounting the lure, and rails extending along the track, a lure speed control assembly comprising:

(a) an electric circuit including the motor, selected rails, and a plurality of inductive loops placed sequentially along the track for traversal by contestants during a race;

(b) an inductance altering element carried by each contestant, each inductance altering element acting to change the inductance in each inductive loop as it is traversed by each contestant; and (c) means in the electric circuit responsive to the change in inductance and operable to modify the speed of the motor, and hence the rate of advancement of the lure, as required to maintain the lure immediately ahead of the lead contestant.

2. The control assembly of claim 1 wherein the inductance altering element is ferromagnetic.

3. The control assembly of claim 1 wherein the selected rails in the electric circuit comprise:

(a) a low voltage rail operable to drive the carriage at a low speed, less than the speed of the lead contestant;

(b) a high voltage rail operable to drive the carriage at a high speed, greater than the speed of the lead contestant, and arranged in the electric circuit to override the low voltage rail when the lead contestant traverses a selected one of the inductive loops; and (c) a ground rail.

4. The control assembly of claim 3 wherein the high voltage rail comprises a plurality of segments, each segment having a voltage selectively applied thereto in relation to the ground rail, each segment being electrically connected to one of the inductive loops, and including a means in the electric circuit for triggering the application of voltage to the high speed rail upon change in inductance in said selected one of the inductive loops.

5. The control assembly of claim 3 wherein each inductive loop extends substantially the width of the track and along the length of the track to a point adjacent to the next inductive loop.

6. The control assembly of claim 1 wherein:

(a) the selected rails comprise a variable voltage rail and a ground rail; and (b) the electric circuit further comprises means for modifying the voltage between the variable voltage rail and the ground rail to achieve a desired lure speed upon traversal of selected ones of the inductive loops by the lead contestant.

7. The control assembly of claim 6 wherein the electric circuit further comprises a sensing means to sense the position of the lure, and a computing means to calculate the relative position of the lure and the lead contestant and the change in voltage of the variable voltage rail.

8. The control assembly of claim 7 wherein the sensing means comprises a plurality of switches arranged at spaced apart locations along the track, and means mounted on the carriage for successively engaging the switches upon passage of the lure.

9. The control assembly of claim 1 wherein the inductance altering element is imbedded in a blanket worn by the contestant.

10. The control assembly of claim 1 wherein the inductance altering element is a flexible foil.

11. The control assembly of claim 1 wherein the inductive loops underlie the track.

12. The control assembly of claim 1 wherein each inductive loop extends substantially across the track.

* * * * *